United States Patent [19]

Thieme et al.

[11] 4,126,088

[45] Nov. 21, 1978

[54] APPARATUS FOR PRESSING LIQUIDS, SUCH AS OIL AND THE LIKE FROM LIQUID CONTAINING MATERIAL

[75] Inventors: Willem L. Thieme, Heemstede; Johan F. Witte, Amsterdam-Nieuwendam, both of Netherlands

[73] Assignee: Stork Amsterdam B.V., Amstelveen, Netherlands

[21] Appl. No.: 830,146

[22] Filed: Sep. 2, 1977

[30] Foreign Application Priority Data

Feb. 9, 1976 [NL] Netherlands ..... 7609802

[51] Int. Cl.[2] ..... B30B 9/08; B30B 9/20

[52] U.S. Cl. ..... 100/45; 100/121; 210/97; 210/384; 425/84; 425/184

[58] Field of Search ..... 100/37, 43, 45, 121, 100/DIG. 6; 210/97–104, 384–389; 209/1, 243, 489, 496; 425/145, 148, 149, 84, 363; 162/358, 363, 368; 222/55, 63

[56] References Cited

U.S. PATENT DOCUMENTS

| | | | |
|---|---|---|---|
| 2,724,327 | 11/1955 | Hetzler | 100/121 |
| 2,915,005 | 12/1959 | Hetzler | 100/121 |
| 3,901,635 | 8/1975 | Greenberger | 425/149 |

*Primary Examiner*—Peter Feldman
*Attorney, Agent, or Firm*—Laurence R. Brown

[57] ABSTRACT

An apparatus for pressing liquids from compressible material comprising a feed path leading to a pair of rollers, followed by an expression path bounded by a portion of the periphery of the main roller and a cage spaced from and surrounding said portion, the feed path being constituted by a horizontal shaker gutter with a metering device for controlling the thickness of the layer of material supplied by the gutter, depending upon the power consumption of the rollers.

5 Claims, 1 Drawing Figure

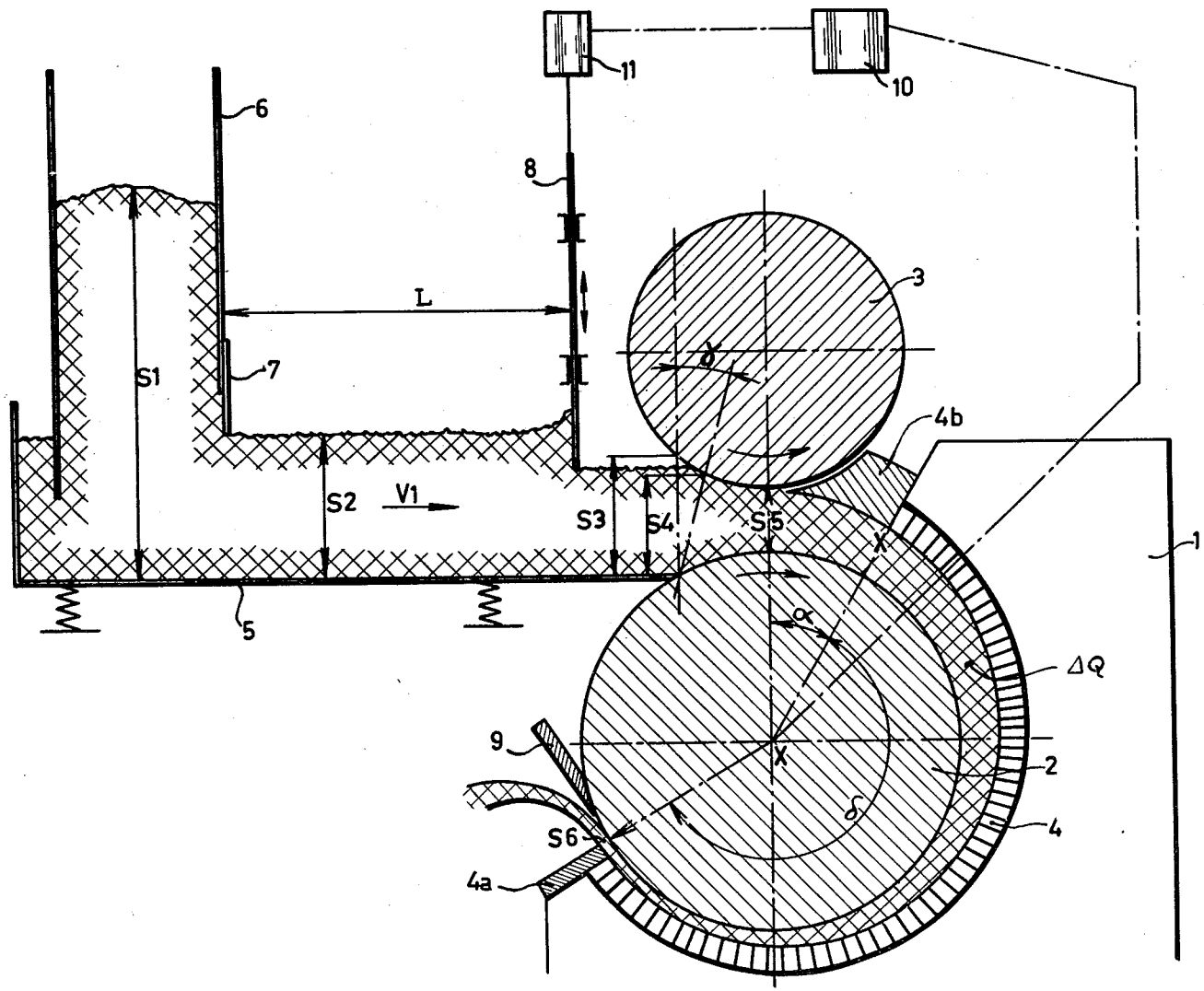
1
ΔQ
2
4
4b
3
10
11
8
L
V1
S1
S2
S3
S4
S5
S6
6
7
5
9
4a

APPARATUS FOR PRESSING LIQUIDS, SUCH AS OIL AND THE LIKE FROM LIQUID CONTAINING MATERIAL

BACKGROUND OF THE INVENTION

The invention relates to an apparatus for pressing liquids, for instance, oil and the like, from liquid containing material, such as fruits and seeds. Said apparatus is provided with a pair of driven rollers with a rough surface, the first main roller of which is partially surrounded by a pressure cage with a specific shape determined by the fluid contents of the material to be pressed, whilst the second roller is located opposite the main roller.

DISCUSSION OF THE PRIOR ART

An apparatus of this type is know per se and is disclosed in Netherlands Pat. Spec. No. 97,009. Said known apparatus has the drawback that a change of the bulk weight of the material to be pressed causes the pressure cage which was shaped for an optimal expression, to operate no longer satisfactorily so that same has to be matched by hand.

SUMMARY OF THE INVENTION

The invention aims to offer a remedy against this disadvantage, which is achieved by conveying the material to be pressed via a substantially horizontal shaker gutter from a supply hopper to the pair of rollers, the main roller of said pair being positioned beneath the second feed roller, whilst near the end of said gutter, means are provided which determine the thickness of the layer of supplied material in response to the motor output consumed by the rollers.

Owing to these features any deviations in the nature of the material supplied (bulk weight) are compensated so that feeding of the material to the actual expression path always takes place under the same circumstances, such that an optimal expression is produced.

A regulation of the supply in dependence of the consumed power is known per se in briqueting presses, for which it is important that the supplied material is evenly spaced ober the width of the rollers.

None of these control systems, however, relate to a compensation of prevailing deviations in the bulk weight of supplied material, and there is no combination with a horizontal shaker gutter which, with the aid of a sliding valve, allows a good automatic metering.

According to the invention, the first contact zone between the upper side of the layer of supplied material to be pressed and the periphery of the feed roller is located downstream with respect to the second contact zone constituted by the lower side of the layer of material and the periphery of the main roller (angle $\gamma$).

Since the feed roller engages the layer of material supplied beyond the end of the shaker gutter, the movement of this shaker gutter is not effected by this roller so that it does not hamper the supply of material.

In a preferred embodiment of the invention, a filling beam is arranged upstream the fluid-permeable pressure cage composed of bars, one side of this beam adjoining the feed roller, the underside bounding the initial expression zone in which, over an arc angle $\alpha$, the preliminary expression takes place; whilst the third side adjoins the pressure cage in which, over an arc angle $\delta$, expression takes place, this zone being closed by a terminal beam.

The portion of the pressing cage in which the initial expression takes place serves to remove the air in the fed material without liquid being removed.

SURVEY OF THE DRAWING

The drawing shows a cross section in a diagrammatical manner of an embodiment.

DESCRIPTION OF A PREFERRED EMBODIMENT

The apparatus comprises a pressing frame 1 in which the main roller 2 and the feed roller 3 (both with a rough surface) are located.

The main roller 2 is surrounded by a pressing cage constructed of bars 4 which are supported in a way as described in Netherlands Pat. Spec. No. 129,315, thus allowing an easy adaption to the kind of material to be pressed. The bars are enclosed by the terminal beam **4*a* and the filling beam 4*b*. The apparatus further comprises a shaker gutter 5 for the supply of the material to be pressed. In a hopper 6 a quantity of material is stored to a level $S_1$. A vertically movable sliding valve 7 is provided to determine a layer thickness $S_2$. Another also vertically movable sliding valve 8 allows to select a layer with a thickness between $S_3$ and $S_4$. A controller 10 registrates the consumed power and translates this information such that a correct position can be selected for the sliding valve 8 which is adjusted by a device 11. A scraper 9 removes the expressed cake from the main roller 2**.

The apparatus in accordance with the invention operates as follows:

The material to be pressed is guided into the shaker gutter 5 via the hooper 6 and, depending on the position of the sliding valve 7 (adjusted to the minimum bulk weight to be expected), there will be produced a layer thickness $S_2$ which, during the operation is reduced by the sliding valve 8 to a layer thickness ranging between $S_3$ and $S_4$.

$S_3$ is the maximally permissible layer thickness of the material with the lowest bulk weight whereby the contact zone of the feed roller 3 on top of this layer lies in the vertical plane through the end of the gutter.

$S_4$ is the minimally permissible layer thickness of the material with the highest bulk weight whereby a minimal initial expression may be performed.

In dependence of the adjusted frequency and the amplitude, the shaker gutter 5 in combination with the sliding valves 7 and 8 provides a regular volume stream of supplied material with a velocity. $V_1$. A deviation in the height of the material level $S_1$ in the hopper 6 which does not vibrate with the gutter 5, does not affect said volume stream.

The distance L between the two sliding valves 7 and 8 (and therefore the total length of the gutter 5) has been chosen such that a regular volume stream over the width of the gutter 5 can take place, so that an even filling (over the width) of the space between the two rollers is ensured.

Thus, the volume stream is guided between the rollers 2 and 3 which rotate in opposite directions; as a rule (but not necessarily) the circumferential velocity of the two rollers 2 and 3 will be equal.

The co-operating rollers 2 and 3 reduce the thickness of the material to a value $S_5$; they further have the function of guiding the material into the pressure chamber constituted by the cage rods 4 and the periphery of the roller 2. The angle $\gamma$ being greater than 0° guarantees an unhampered functioning of the vibrating gutter 5.

During this reduction no liquid runs out as yet. In the pressure chamber the material is further reduced to a layer thickness $S_6$ over a path formed by the angles $\alpha + \delta$. On path $\alpha$ still no liquid is driven out. On path $\delta$ it counts for each material particle $\Delta Q$ that at least so much oil is driven out through the cage bars 4 that oil never flows back against the direction of motion of the solid material mass over the separation line $x - x$ between the paths $\alpha + \delta$.

If now a deviation occurs in the bulk weight (for instance a decrease), the velocity $V_1$ of the material stream on the shaker gutter 5 and the layer thickness $S_2$ remain equal, whereas the mass stream per time unit, however, decreases. This implies that in the initially adjusted layer between $S_3$ and $S_4$ too small an amount of solid material is supplied, so as to effect a correct expression in the path $\alpha + \delta$ so that the consumed power will decrease. Information to this effect forwarded to the sliding valve 8 results in an increase of the thickness of the layer towards $S_3$ and in the supply of more solid material, so that the balance will be re-established due to which the expression will always be continued under optimal conditions.

What we claim is:

1. An apparatus for pressing liquids, for instance oil and the like, from liquid containing material, such as fruits and seeds, the apparatus comprising a pair of driven rollers with a rough surface the first main roller of which is partially surrounded by a pressure cage with a specific shape determined by the liquid contents of the material to be pressed, whilst the second roller is located opposite the main roller, a substantially horizontal shaker gutter being provided for conveying the material to be pressed from a supply hopper to the pair of rollers, the main roller of which being positioned beneath the second roller, which functions as a feed roller, means being arranged next to the end of the shaker gutter to determine the layer thickness of the supplied material, in response to the motor output consumed by the rollers.

2. The apparatus as defined in claim 1, wherein the material conveyed from the gutter first engages the upper roller at a first contact zone and first engages the main roller at a second contact zone, and wherein the first contact zone between the upper side of the layer of supplied material to be pressed on the periphery of the upper feed roller is located downstream with respect to the second contact zone.

3. An apparatus as defined in claim 2, wherein the second contact zone is constituted by the lower side of material to be pressed and the periphery of the main roller.

4. The apparatus as defined in claim 1, wherein upstream of the liquid permeable pressure cage, composed of bars, a filling beam is arranged of which one side adjoins the feed roller, the underside of the filling beam bounding the initial expression zone in which a preliminary expression takes place over an arc angle $\alpha$ and the third side of the filling beam adjoining the pressure cage, in which pressing takes place over an arc angle $\delta$.

5. An apparatus as claimed in claim 4, wherein the expression zone is closed by means of a terminal beam.

* * * * *